United States Patent [19]

Ruether et al.

[11] Patent Number: 5,015,366

[45] Date of Patent: May 14, 1991

[54] PROCESS AND APPARATUS FOR COAL HYDROGENATION

[75] Inventors: John A. Ruether, McMurray, Pa.; Theodore B. Simpson, McLean, Va.

[73] Assignee: The United States of America as represented by the United States Department of Energy, Washington, D.C.

[21] Appl. No.: 506,739

[22] Filed: Apr. 10, 1990

[51] Int. Cl.[5] ..... C10G 1/08

[52] U.S. Cl. ..... 208/408; 208/415; 208/420; 208/426; 208/429; 208/430; 208/435; 44/572; 44/574

[58] Field of Search ..... 208/408, 415, 420, 426, 208/429, 430, 435; 44/24

[56] References Cited

U.S. PATENT DOCUMENTS

| | | | |
|---|---|---|---|
| 2,609,331 | 9/1952 | Cheney | 202/11 |
| 2,753,296 | 7/1956 | Sellers | 196/53 |
| 3,152,063 | 10/1964 | Schroeder et al. | 208/408 |
| 3,321,393 | 5/1967 | Schuman et al. | 208/408 |
| 3,748,254 | 12/1971 | Gorin | 208/418 |
| 3,791,957 | 12/1971 | Wolk | 208/408 |
| 3,971,635 | 7/1976 | Matthews | 48/202 |
| 3,971,638 | 7/1976 | Matthews | 48/202 |
| 3,971,639 | 7/1976 | Matthews | 48/202 |
| 4,021,206 | 5/1977 | Huberts et al. | 44/10 R |
| 4,111,787 | 9/1978 | Aldridge et al. | 208/408 |
| 4,111,788 | 9/1978 | Chervenak et al. | 208/408 |
| 4,133,742 | 1/1979 | Hill | 208/418 |
| 4,153,419 | 5/1979 | Clayfield et al. | 44/23 |
| 4,206,713 | 6/1980 | Ryason | 110/347 |
| 4,264,429 | 4/1981 | Rosenthal et al. | 208/408 |
| 4,294,584 | 10/1981 | Verschuur | 44/23 |
| 4,309,190 | 1/1982 | Baron et al. | 44/16 |
| 4,403,996 | 9/1983 | Matsuura et al. | 44/1 G |
| 4,422,246 | 12/1983 | Hardesty et al. | 34/9 |
| 4,437,973 | 3/1984 | Huibers et al. | 208/408 |
| 4,571,294 | 2/1986 | Friedman et al. | 208/418 |
| 4,735,706 | 4/1988 | Ruether | 208/426 |

OTHER PUBLICATIONS

White et al., "Biomass Liquefaction Utilizing Extruder-Feeder Reactor System", American Chemical Society, Apr. 1987.

Kushida, et al., "Coal Pump Development—Phase III, Final Report", JPL 1980.

*Primary Examiner*—Anthony McFarlane
*Assistant Examiner*—Nhat Phan
*Attorney, Agent, or Firm*—Hugh W. Glenn; Robert J. Fisher; William R. Moser

[57] ABSTRACT

In a coal liquefaction process an aqueous slurry of coal is prepared containing a dissolved liquefaction catalyst. A small quantity of oil is added to the slurry and then coal-oil agglomerates are prepared by agitation of the slurry at atmospheric pressure. The resulting mixture is drained of excess water and dried at atmospheric pressure leaving catalyst deposited on the agglomerates. The agglomerates then are fed to an extrusion device where they are formed into a continuous ribbon of extrudate and fed into a hydrogenation reactor at elevated pressure and temperature. The catalytic hydrogenation converts the extrudate primarily to liquid hydrocarbons in the reactor. The liquid drained in recovering the agglomerates is recycled.

8 Claims, 1 Drawing Sheet

PROCESS AND APPARATUS FOR COAL HYDROGENATION

CONTRACTUAL ORIGIN OF THE INVENTION

The U.S. Government has rights in this invention pursuant to the employee/employer relationship of the inventor to the U.S. Department of Energy at the Pittsburgh Energy Technology Center.

BACKGROUND OF THE INVENTION

The present invention relates generally to a method for the hydrogenation or liquefaction of coal, and more particularly to a method of continuously converting coal particulates to liquid hydrocarbon products.

In continuous direct coal liquefaction processes, pulverized coal is fed as a slurry including a portion of the coal liquefaction product. The coal slurry is usually pressurized by a pump, passed through a preheater and then into a reactor where the coal is converted to liquid and gaseous products under the influence of elevated temperature and hydrogen pressure. The maximum solids content of the feed slurry in such previous processes is limited to slightly more than 40 weight percent since with greater solids content the slurry becomes so viscous as to be unpumpable. The use of such relatively large concentrations of solvent with the feed coal is disadvantageous in that it is wasteful of energy since the solvent must be heated to reaction temperature along with the coal and is also wasteful of the interior volume of process equipment in that only about 50 percent or less by volume of the feed slurry consists of coal. Thus, it is desirable to have an alternative method to the conventional coal/solvent slurry for feeding coal to a liquefaction process.

It is also known within the art that an efficient method for introducing catalysts into a coal liquefaction system is through impregnation from solution. The catalysts are often salts of transition metals such as iron, molybdenum, nickel or tin. If water-soluble salts are used, the catalysts may be impregnated from an aqueous solution. Compared to other methods of catalyst addition, impregnated catalysts are efficacious at small concentrations, which is thought to be due to the highly dispersed nature of the catalysts within the coal particles and the proximity of catalysts to reactive sites in the coal.

The direct liquefaction of coal in the presence of large amounts of water is also known in the art. Batchwise reactions have been carried out using ratios of coal-to-water that could be obtained from a pumpable slurry of coal and water. A major disadvantage to carrying out liquefaction in the presence of large quantities of water is the contribution of the vapor pressure of water to the total system pressure. Typically such liquefaction is carries out at a total pressure in the vicinity of 4,000 psig or higher which is not economically attractive.

In U.S. Pat. No. 4,735,706 to the inventor, Ruether, coal-oil agglomerates are prepared in an aqueous slurry and the resulting mixture pumped to reaction pressure where excess water and unagglomerated solids are removed. Sufficient catalyst, previously dissolved in the aqueous solution, remains deposited on the agglomerates entering the liquefaction reactor. Although this process is effective and useful it has the disadvantage of requiring dewatering and drying at elevated pressures which can substantially increase process equipment cost. This prior patent is incorporated by reference herein for describing the background of the present invention, the preparation of coal-oil agglomerates and for other purposes as will be seen below.

SUMMARY OF THE INVENTION

In accordance with the present invention a method for introducing carbonaceous material at elevated pressure and temperature into a hydrogenation reactor is provided. The method involves providing an aqueous slurry of the carbonaceous material as finely divided particulates with water and water soluble catalyst in sufficient proportions to effect dissolution and dispersion of the catalyst throughout the slurry. A sufficient amount of oil is mixed into the slurry to form agglomerates of the finely divided carbonaceous material and the agglomerates are separated at atmospheric pressure from the excess aqueous solution and unagglomerated solids. The agglomerates are then dried to remove essentially all of the moisture and to deposit solute catalyst onto the agglomerates. The coal-oil agglomerates as thus provided with deposited catalyst are extruded as a continuous ribbon into the hydrogenation reactor at elevated pressure and elevated temperature, but with the extrusion temperature below that at which the carbonaceous material without the added oil enters a plastic condition.

In other aspects of the invention, particulate mineral matter along with the excess aqueous solution is separated from the agglomerates prior to the extruding step. The separated aqueous solution and particulate mineral matter are further processed to recover and recycle the aqueous solution containing dissolved catalyst to the aqueous slurry. The particulate coal is formed into agglomerates at about atmospheric pressure and at a temperature below about 90° C., dried in a heated gas at a temperature of no more than 200° C. and the agglomerates are then heated to no more than 320° C. while extruding them as a continuous ribbon into the hydrogenation reactor at a pressure of not less than 70 atmospheres.

An embodiment of the method includes feeding coal from at about atmospheric pressure into a hydrogenation reactor at an elevated temperature and pressure by preparing an aqueous slurry of particulate coal with mineral matter and water soluble catalyst in water. Sufficient oil is added into the slurry to form coal-oil agglomerates typically of about 1 to 4 mm diameter leaving much of the mineral matter essentially as unagglomerated solids. The coal-oil agglomerates are separated from the unagglomerated mineral matter and the agglomerates dried at about atmospheric pressure by contact with a heated gas to form moisture-free agglomerates of 70–90% by weight coal and 10–30% by weight oil. The agglomerates are extruded at a temperature of no more than 320° C. to introduce a continuous ribbon of extrudate into the hydrogenation reactor at a pressure of about 70 to 250 atmospheres.

BRIEF DESCRIPTION OF THE DRAWINGS

The present invention is illustrated in the accompanying drawings wherein.

DETAILED DESCRIPTION OF THE PREFERRED EMBODIMENTS

Figure 1:
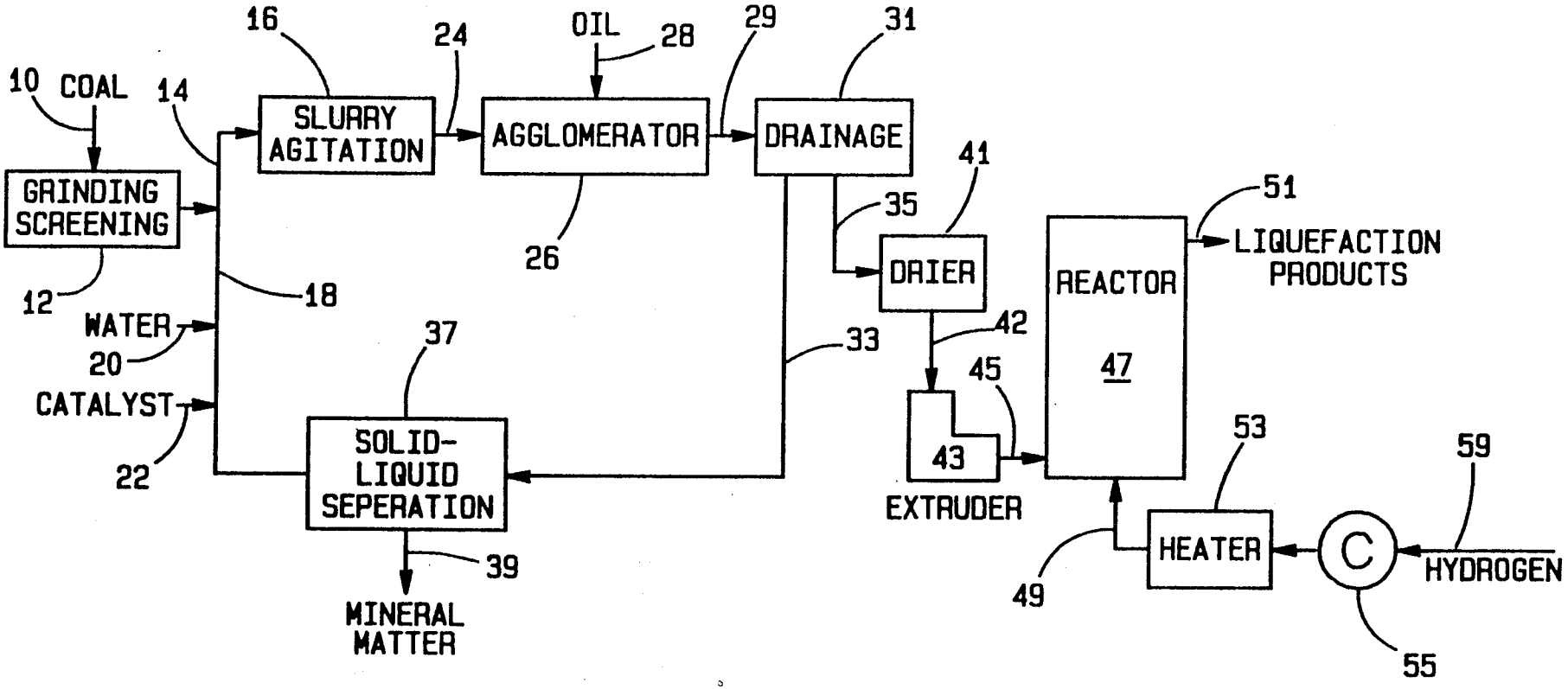
FIG. 1 is schematic of a coal hydroliquefaction process.

In general coal-oil agglomerates are prepared in the manner described in U.S. Pat. No. 4,735,706 cited above. This U.S. Patent is incorporated by reference herein for this and other related disclosures, e.g. the operation of the hydrogenation reactor.

Coal-oil agglomerates can be prepared in a size range of less than 1 millimeter (mm) to greater than 1 centimeter in diameter. Agglomerates in a size range of about 1 to 4 mm are preferred for use in the present invention. With agglomerates in this size range, most of the water present during agglomerate formation can be removed by a simple draining step. The moisture content of the drained agglomerates is in a range of about 8 to 20 percent by weight of the dry coal in the agglomerates. The concentration of catalyst desired for the coal fed to the reactor can be readily provided by incorporating a water soluble catalyst in the coal slurry used to prepare the agglomerates. The water-soluble catalyst adheres to the coal particles when the water is evaporated from the agglomerates.

With reference to the drawing, coal 10 such as bituminous or sub-bituminous coal is conveyed through a preparation unit 12 where the coal is ground to a desired particulate size of less than 60 mesh (U.S. Standard Sieve Series) and screened for uniformity. The pulverized coal is passed through conduit 14 into an agitated slurry mixing tank 16. Water and dissolved catalyst provided by a recycle loop, as will be described below, are conveyed through conduit 18 into tank 16 for forming a coal-water slurry of uniform composition. Also added to tank 16 are make-up water and make-up catalyst through conduits 20 and 22, respectively. The ratios of coal-to-water fed into tank 16 are such as to give favorable conditions for forming coal-oil agglomerates and can be satisfactorily accomplished by using a slurry containing about 10 to 40 weight percent dry coal. Also, the feed rate of the make-up catalyst through conduit 22 is such a to give the desired catalyst concentration in tank 16 which depends upon the moisture content of agglomerates downstream in the process and the desired catalyst concentration with the agglomerates used in the hydrogenation reaction.

The catalyst utilized is a water-soluble salt of a transition metal. For example, materials such as ammonium tetramolybdate, ammonium paramolybdate, ferrous sulfate heptahydrate, ferrous nitrate hexahydrate, and nickel sulfate and its hydrates are satisfactory for the practice of the present invention. The concentration of molybdenum-containing salts found to be sufficient for effecting desirable coal-to-liquid conversions in a reactor is in the range of about 0.005 to 0.5 weight percent molybdenum expressed as a percentage of dry coal in the agglomerates fed into the reactor. Preferably this range is 0.01 to 0.25 weight percent molybdenum. For iron-containing salts, the concentration is 0.2 to 2.0 weight percent iron. However, any water-soluble catalytic material known in the art may be satisfactorily used in the practice of the present invention. Typically, the catalyst will be in an amount less than 2% by weight of the dry coal.

The aqueous mixture or slurry of coal and dissolved catalyst leaves the slurry-forming tank 16 via conduit 24 and enters the agglomerate forming vessel 26. Oil is added to vessel 26 through conduit 28 in an amount sufficient to produce agglomerates in the preferred size range of about 1 to 4 mm. This agglomeration can be accomplished by the use of oil in the amount of about 10 to 35 weight percent of the weight of the dry coal fed into vessel 26. Agglomeration of the coal may be achieved in the agglomerator vessel by generation of sheer forces through the use of agitators or any other suitable agitating devices as known in the art. The oil can be conveniently supplied by the process but this is not necessary.

The mixture is discharged from the agglomerator vessel 26 through conduit 29 and consists essentially of agglomerates, excess water, dissolved catalyst, and unagglomerated solids consisting primarily of mineral matter.

The slurry mixture of coal-oil agglomerates and water enters a drainage device 31 for separating moist coal-oil agglomerates in conduit 35 from most of the water and unagglomerated solids discharged through conduit 33. Drainage device 31 can be any suitable commercially available screening or drainage equipment for operating essentially at atmospheric pressure. As an example, the sieve-providing conduit disclosed in the above cited U.S. Pat. No. 4,735,706 would be suitable in the present application for operation at atmospheric pressure.

The major portion of the water and unagglomerated solids removed through conduit 33 passes to a solid-liquid separation device 37 such as a solid-liquid settler from which essentially all of the finely divided mineral matter is removed for disposal in stream 39 leaving the water and dissolved catalysts to be recycled in conduit 18 to the slurry agitation step.

The moist coal-oil agglomerates are conveyed by screw or other mechanical means at 35 to a drier 41. Drier 41 can operate by passing warm gas, such as heated air substantially at atmospheric pressure, over the surface of the agglomerates. The warm gas can be recycled in part to increase velocity at the agglomerate surfaces, but it is kept at a sufficiently low temperature such that the agglomerates do not melt nor lose their generally spherical form. Typically, well-known driers such as a gravity flow or a rotary drum drier at moderate rotational velocities can be used. The coal-oil agglomerates, substantially free of moisture, at atmospheric pressure are passed from drier 41 via conduitor conveyor 42 to a extruder 43 for feeding the substantially solid agglomerates from atmospheric pressure into a hydrogenation reactor 47. Reactor 47 operates at temperatures in the range of 340–450° C. and at pressures in the range of 70–250 atmospheres. Extruder 43 is of a type well-known in the art suitable for forming ribbons of extrudate across elevated pressures of the range disclosed while sealing to prevent release of the reactor gases. One particularly suitable extrusion device is a single screw extruder which is described and disclosed in the Society of Plastics, Industries, *Plastics Engineering Handbook*, 158–174 (1976).

The extruder can be equipped with a heater along its barrel to supplement the heat generated by the mechanical work of extrusion. The coal-oil feed must be heated sufficiently to support an essentially adiabatic reaction within the reactor 47 but must not be heated to the reaction temperature in the absence of hydrogen gas. Inasmuch as little or no gaseous hydrogen is present in the extruder, the coal-oil feed must not be heated above 320° C. or its reactivity for hydroliquefaction will be substantially impaired. Therefore, the coal-oil feed material must not exceed a temperature of 320° C. in the extruder.

The coal-oil feed leaving extruder 43 through passage 45 will enter reactor 47 as a continuous ribbon of extrudate but at a temperature below that at which coal without the added oil softens into a plastic condition (typically 340–360° C.). Within reactor 47, the coal-oil extrudate is further heated by contact with the flow of heated, high-pressure hydrogen entering through conduit 49 and by the exothermic hydrogenation reaction to produce a carbonaceous liquefaction product withdrawn at conduit 51.

Hydrogen is fed to reactor 47 through conduit 49 after being compressed to reactor pressure in compressor 55 and heated in heater 53. Additional heat beyond that generated by the exothermic liquefaction reaction is required to support the hydroliquefaction reaction. This heat is supplied via the feed hydrogen which can be heated as required for thermal balance to a temperature up to 450° C. in heater 53 before entering reactor 47.

Reactor 47 can be of a known, slurry bubble column design with the extrudate entering at the bottom and the liquefaction products and unreacted solids withdrawn from conduit 51 near the top. The product of liquid and unreacted solids can be subjected to any further treatment as desired. For example, the present invention is particularly suitable for providing a first-stage liquefaction product that may be uPGraded in a second catalytic hydrotreatment stage such as taught in U.S. Pat. Nos. 3,791,957; 4,111,788; and 4,264,429.

The present invention provides several advantages over previously employed processes for conducting direct liquefaction of coal. The draining and drying of the agglomerate at atmospheric pressure instead of at elevated reaction pressure permits the use of less expensive and easier to control equipment. Plant operators and maintenance personnel will have access to the equipment to permit smoother performance of the process. Moreover, the drying loop of the above-cited U.S. Pat. No. 4,735,706, including a dryer-preheater, condensor and hydrogen gas compressor, can be eliminated when water removal and drying are carried out at atmospheric pressure.

It will also be seen that the reactor of the present invention can be of simpler construction than that of the reactor and preheater dryer of the above cited U.S. Pat. No. 4,735,706. Coal-oil extrudate as a continuous ribbon enters reactor 47 at the lower portion thereof, thus negating the need for an arrangement of baffles as previously required to prevent short circuiting of the coal feed into the liquefaction product.

Although the present invention is described in terms of specific materials and process steps, it will be clear to one skilled in the art that various changes and modifications may be made in accordance with the invention as described in the accompanying claims.

The embodiment of the invention in which an exclusive property or privilege is claimed is defined as follows:

1. In a method for processing carbonaceous material containing mineral matter and feeding the carbonaceous material into a hydrogenation reactor operating at an elevated pressure of about 70 to 250 atmospheres and at a temperature in excess of the plastic softening temperature of the carbonaceous material, the method including the steps of providing an aqueous slurry of the carbonaceous material and mineral matter as finely divided particulates with water and water soluble catalyst in sufficient proportions to effect dissolution and dispersion of the catalyst throughout the slurry, mixing a sufficient amount of oil into the slurry to form agglomerates of the finely divided carbonaceous material and oil while leaving the mineral matter essentially as unagglomerated solids; the improvement comprising separating the agglomerates of carbonaceous material from the slurry containing the unagglomerated mineral matter at about atmospheric pressure;

separating the mineral matter from residual solution containing dissolved catalyst and recycling the residual solution and catalyst to provide aqueous slurry;

drying the carbonaceous agglomerates at about atmospheric pressure to remove essentially all of the moisture and to deposit solute catalyst onto the agglomerates;

extruding the agglomerates with deposited catalyst from about atmospheric the agglomerates to the elevated pressure and at a temperature below that at which the carbonaceous material without the added oil enters a plastic condition and feeding the extruded agglomerates into the hydrogenation reactor.

2. The method of claim 1 wherein the carbonaceous material is particulate coal.

3. The method of claim 2 wherein the agglomerates are dried at about atmospheric pressure by contact with heated gas at a temperature of no more than 200° C. to form essentially moisture-free agglomerates of 70–90% by weight coal and 10–30% by weight oil.

4. The method according to claim 1 wherein the particulate coal is formed into agglomerates at about atmospheric pressure and at a temperature below about 90° C. and the agglomerates are heated to no more than 320° C. while extruding them into the hydrogenation reactor at a pressure of about 70 to 250 atmospheres.

5. The method according to claim 1 wherein the agglomerates are dried at about atmospheric pressure by passing heated gas into contact with the agglomerates at a temperature below the plastic temperature of the coal and below that at which the gas will chemically react with the coal.

6. The method according to claim 5 wherein the heated gas is air at a temperature of no more than 200° C.

7. A method of feeding coal from at about atmospheric pressure into a hydrogenation reactor at an elevated temperature and pressure comprising:

providing a slurry of particulate coal including particulate mineral matter in water with water-soluble catalyst dissolved in the water;

mixing a sufficient amount of oil into the slurry to form coal-oil agglomerates of about 1 to 4 mm diameter leaving mineral matter essentially as unagglomerated solids;

separating the coal-oil agglomerates from the unagglomerated mineral matter;

drying the agglomerates at about atmospheric pressure by contact with a heated gas to form moisture-free agglomerates of 70–90% by weight coal and 10–30% by weight oil;

extruding the coal-oil agglomerates at a temperature of no more than 320° C. to introduce a continuous extrudate of coal and oil into the hydrogenation reactor at a pressure of about 70 to 250 atmospheres.

8. The method of claim 7 wherein the particulate coal and mineral matter is of no more than 0.25 mm and the coal agglomerates are of about 1 to 4 mm.

* * * * *

UNITED STATES PATENT AND TRADEMARK OFFICE

CERTIFICATE OF CORRECTION

PATENT NO. : 5,015,366

DATED : May 14, 1991

INVENTOR(S) : John A. Ruether and Theodore B. Simpson

It is certified that error appears in the above-identified patent and that said Letters Patent is hereby corrected as shown below:

Claim 1, Column 6, lines 17 and 18, reading:

extruding the agglomerates with deposited catalyst from about atmospheric the agglomerates to the should read:

extruding the agglomerates with deposited catalyst from about atmospheric pressure to the

Signed and Sealed this

Sixth Day of October, 1992

*Attest:*

DOUGLAS B. COMER

*Attesting Officer*

*Acting Commissioner of Patents and Trademarks*